United States Patent [19]

Roosa

[11] Patent Number: 4,922,556

[45] Date of Patent: May 8, 1990

[54] FLUSHING MEANS

[75] Inventor: Vernon D. Roosa, West Hartford, Conn.

[73] Assignees: Elwyn V. Harp, West Hartford; Glen H. Baron, Simsbury, both of Conn.

[21] Appl. No.: 339,396

[22] Filed: Apr. 17, 1989

Related U.S. Application Data

[62] Division of Ser. No. 118,437, Nov. 9, 1987, Pat. No. 4,842,011.

[51] Int. Cl.[5] ..... E03D 1/34

[52] U.S. Cl. ..... 4/378; 4/366; 4/391; 4/394; 4/324; 4/415; 137/426

[58] Field of Search ..... 4/382, 391, 378, 366, 4/415, 324, 325, 393, 398, 383, 382, 381; 137/426

[56] References Cited

U.S. PATENT DOCUMENTS

| | | | |
|---|---|---|---|
| 363,166 | 5/1887 | Platt | 4/382 |
| 1,606,364 | 11/1926 | Haas | 4/391 |
| 1,623,811 | 4/1927 | Pownall | 137/426 X |
| 3,296,630 | 1/1967 | Clark | 4/393 X |
| 4,183,107 | 1/1980 | Hare et al. | 4/415 X |
| 4,365,364 | 12/1982 | Riedel | 4/393 X |
| 4,388,737 | 6/1983 | Wenzel | 4/415 |
| 4,467,482 | 8/1984 | Dyer | 4/395 |
| 4,483,024 | 11/1984 | Troeh | 4/381 |
| 4,566,140 | 1/1986 | Musgrove | 4/415 |
| 4,601,071 | 7/1986 | Parsson | 4/395 X |
| 4,615,056 | 10/1986 | Grant | 4/366 |
| 4,794,946 | 1/1989 | Antunez | 137/426 |

FOREIGN PATENT DOCUMENTS

| | | | |
|---|---|---|---|
| 681923 | 10/1952 | United Kingdom | 4/390 |

*Primary Examiner*—Henry K. Artis

*Attorney, Agent, or Firm*—Stoll, Previto & Hoffman

[57] ABSTRACT

An improved flushing means is disclosed for use in water tanks such as are for flushing toilets. The flushing means has a water inlet with an improved two-stage valve using inlet line pressure for operating the two stages. A float is movably mounted on the inlet for controlling the valve with a lever operatively coupling the float to the first stage of the valve. A cooperating vertical hollow and floating overflow tube including an adjustable bowl filling siphon controls the tank discharge to the bowl. These improvements to the tank discharge to the bowl are also to be incorporated into the commonly used flapper-type flush valve.

1 Claim, 5 Drawing Sheets

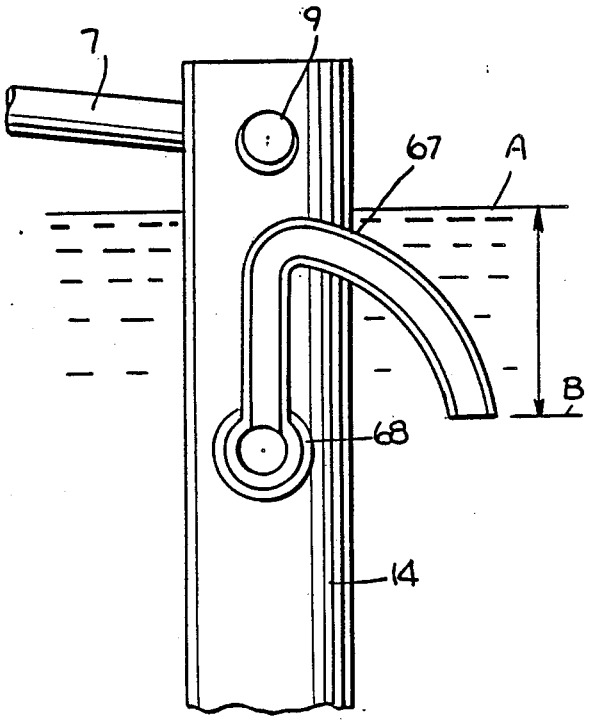
Fig. 7.
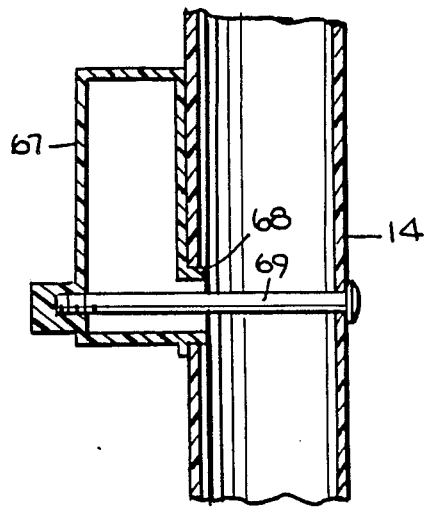
Fig. 6.
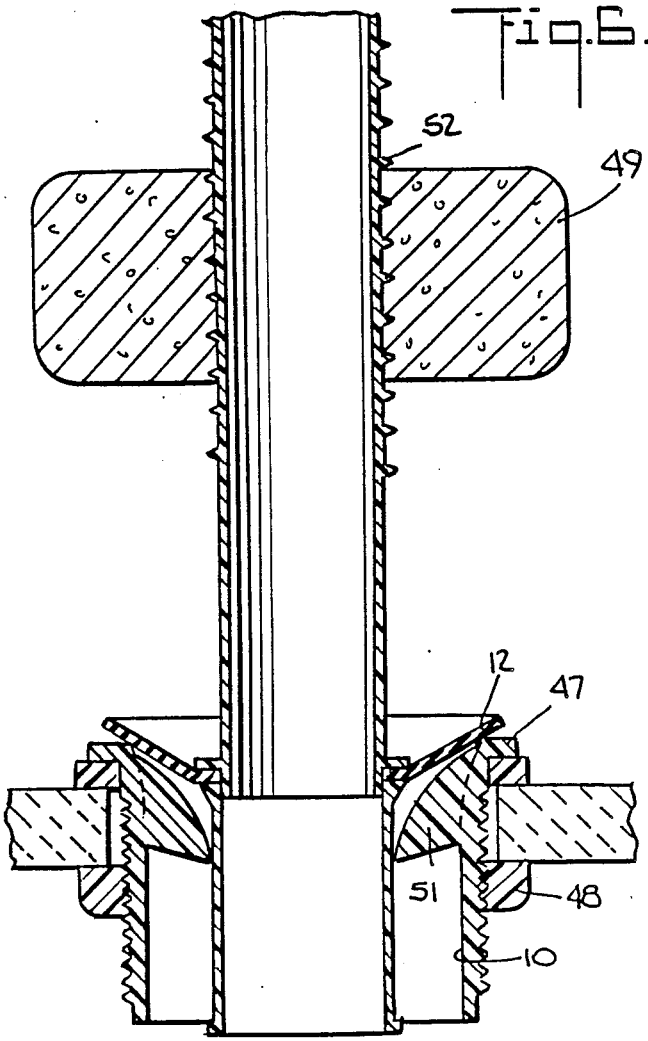
Fig. 8.
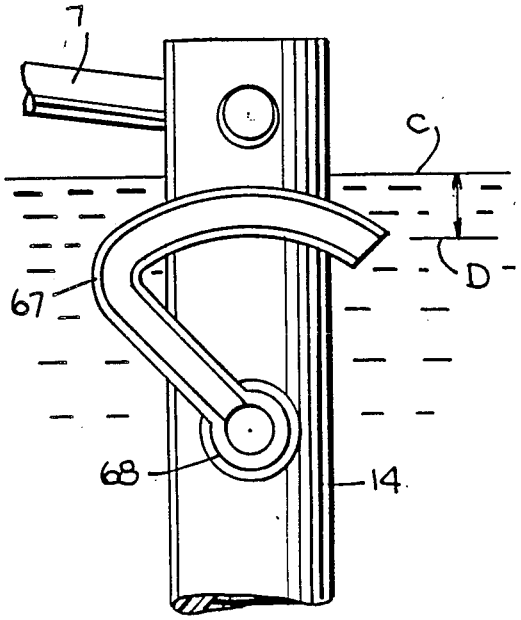

FLUSHING MEANS

RELATED APPLICATION

This application is a division of pending U.S. patent application Ser. No. 118,437 filed Nov. 9, 1987 and now U.S. Pat. No. 4,842,011.

BACKGROUND OF THE INVENTION

The present invention relates to an improved flushing device for use in tanks for flushing toilets.

The device of this application is an improvement upon the devices of U.S. Pat. Nos. 3,982,556 and 4,341,238 of which I am a co-inventor.

The flushing device, in accordance with the present invention, is also an improvement over various other well-known flushing devices. It provides a positively acting and reliable flushing action as well as an adjustable bowl filling action in a simplified structure employing a minimum number of parts most of which are readily molded from plastic.

There are several prior flushing device designs which utilize combinations of water inlet control valves and cooperating water tank flushing valves. These piror flushing devices use relatively large and complex inlet valves, flushing valves and bowl leveling means. The flushing device of the present invention incorporates an extremely simple and reliable inlet valve adapted for having its principal portions formed of molded plastic and having a simplified two stage valve action using inlet water pressure for the second stage shut-off. The cooperating tank flushing valve has improved valving and bowl leveling means.

Accordingly, an object of the present invention is to provide an improved and greatly simplified tank bowl flushing device.

Another object of the present invention is to provide a tank flushing device combining simplicity with assured positive action and which is adapted for being manufactured almost completely from molded plastic.

Another object of the present invention is to provide an improved adjustable flush valve for a flushing device.

Another object of the present invention is to provide an improved adjustable bowl leveling means in a tank filling means.

Other and further objects of the invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 6 is a side elevational view, partially in section, of the flush valve.

FIG. 7 is a vertical sectional view of the flush valve siphon for bowl leveling.

FIG. 8 is a detailed front elevational view of the bowl leveling siphon.

DESCRIPTION OF THE PREFERRED EMBODIMENT

Figure 1:
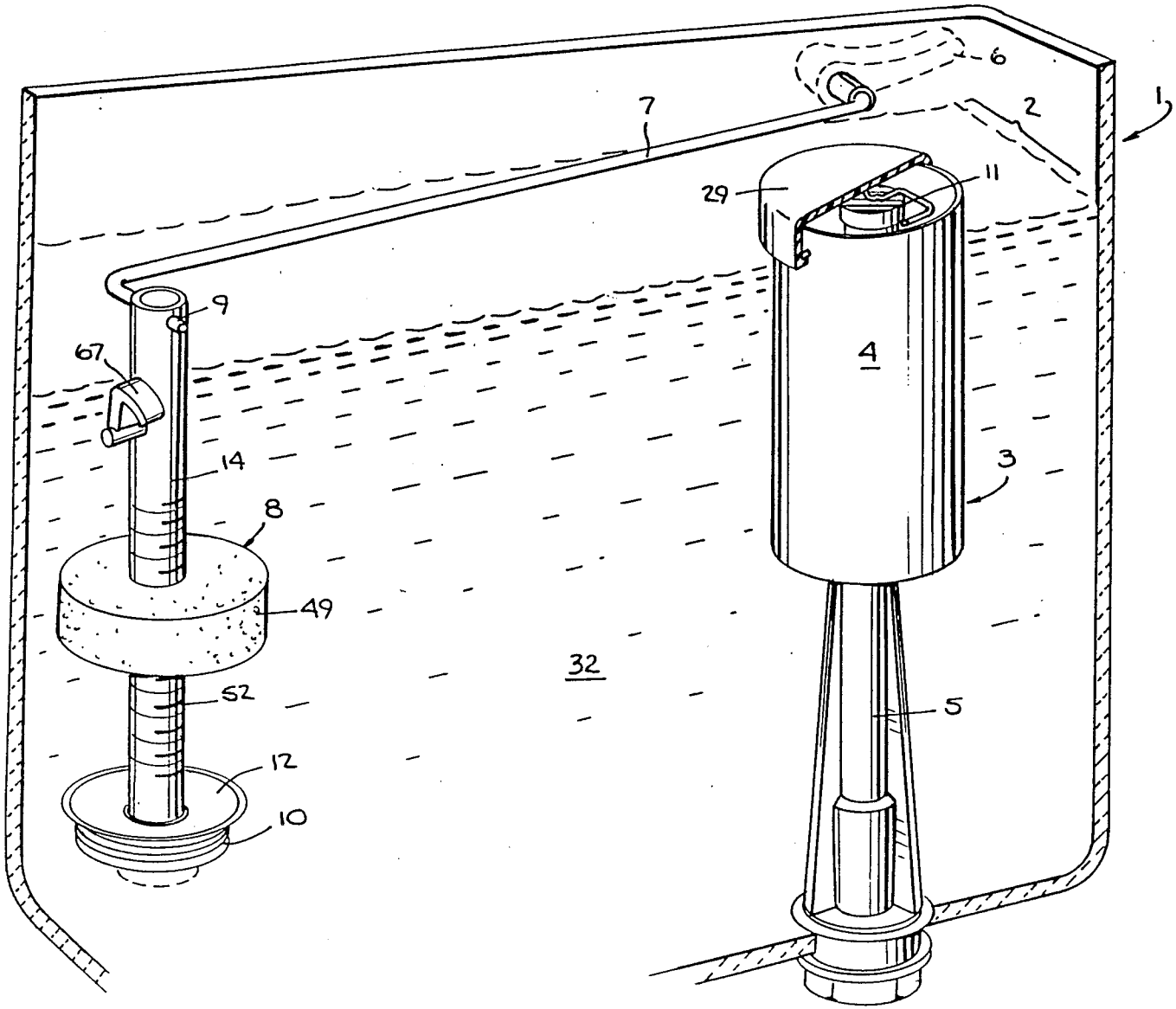
FIG. 1 is a perspective view illustrating a preferred embodiment of the flushing means of the present invention positioned in a toilet flush tank.

FIG. 1 illustrates a flush tank 1 with an improved flushing means 2 in accordance with the present invention. The tank 1 in FIG. 1 is in its filled condition preparatory to a flushing cycle. A water inlet assembly 3 is illustrated at the right side of the tank 1.

The inlet assembly 3 includes a float 4, for inlet valve operation, slidably mounted on the upper end of an inle fitting 5. The float 4 controls the water inlet assembly 3 during a flushing cycle as controlled by the level of the water 32 in the tank 1.

The flushing cycle is initiated by a flush handle 6 which is turned to raise the left end (FIG. 1) of a flushing lever 7 and a connected flush valve 8. Raising the flush valve 8 opens the flush outlet 10 to a connected toilet bowl to cause the usual siphon or overflow flushing therein.

The lowering water level in the tank 1 causes the slidably mounted float 4 to drop on the inlet fitting 5 to open an inlet valve 11 (FIG. 4) for starting the tank 1 filling action. The flush valve 8 which floats on the water in tank 1 drops with the falling water level until its sealing gasket 12 results the tank outlet 10. Water continues to flow inwardly through the opened inlet valve 11 filling the tank 1 and raising the float 4 upwardly to the inlet valve 11 closing position.

The preferred improved embodiments of the water inlet assembly 3 and the flush valve 8 will now be described in greater detail.

THE TANK WATER INLET ASSEMBLY

FIGS. 2 through 5 illustrate details of the preferred inlet assembly 3 which includes the inlet fitting 5 (FIGS. 2 and 3) mounted vertically in the tank 1 in an inlet aperture 15 in the tank 1 bottom 16. The inlet fitting 5 may include radial reinforcing flanges 17 positioned above a threaded portion 18. A nut 19 completes a watertight mounting of the inlet fitting 5 on the tank bottom 16 by fastening the inlet fitting 5 in the aperture 15 on a resilient annular sealing washer 20.

Figure 2:
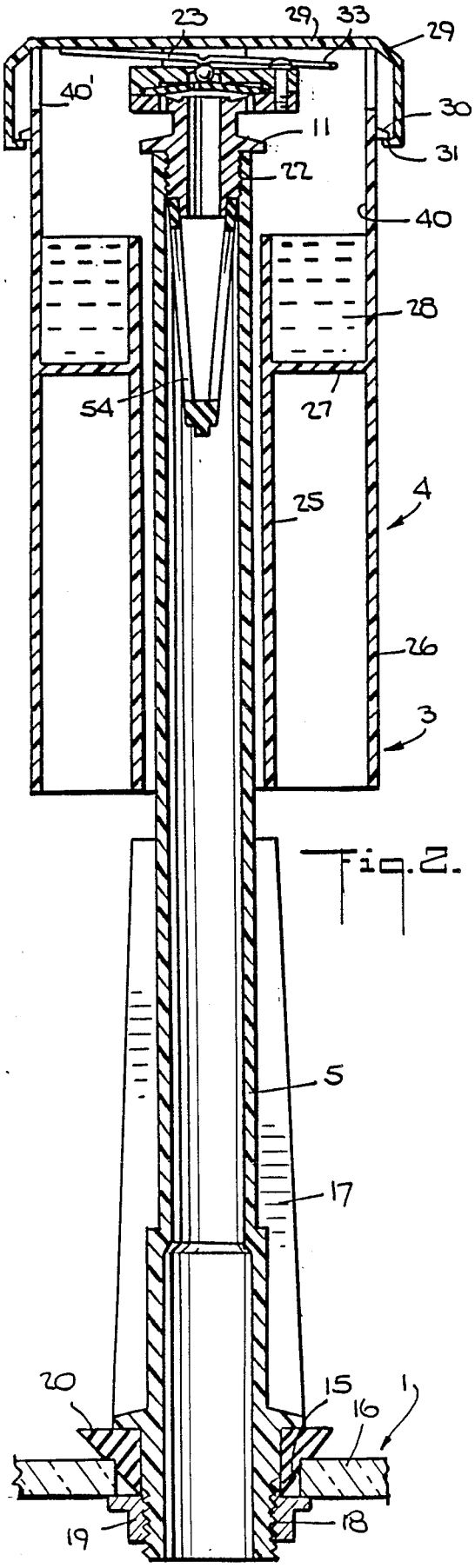
FIG. 2 is an enlarged detailed cross sectional view of the fluid inlet valve in its open position.
Figure 3:
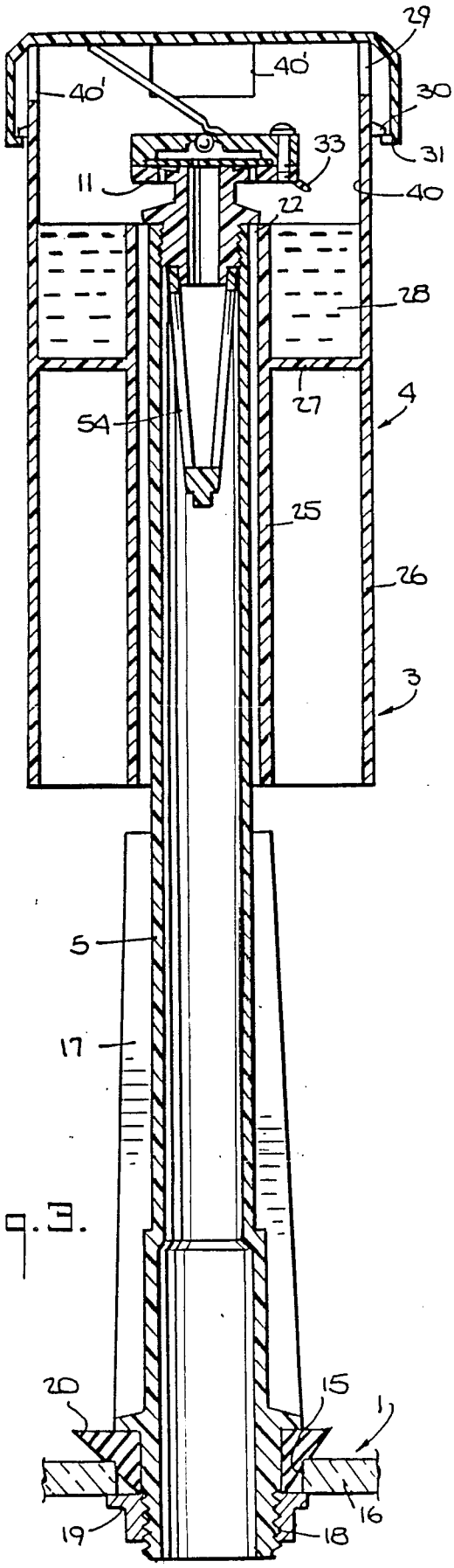
FIG. 3 is an enlarged detailed cross sectional view of the inlet valve in its closed position.
Figure 5:
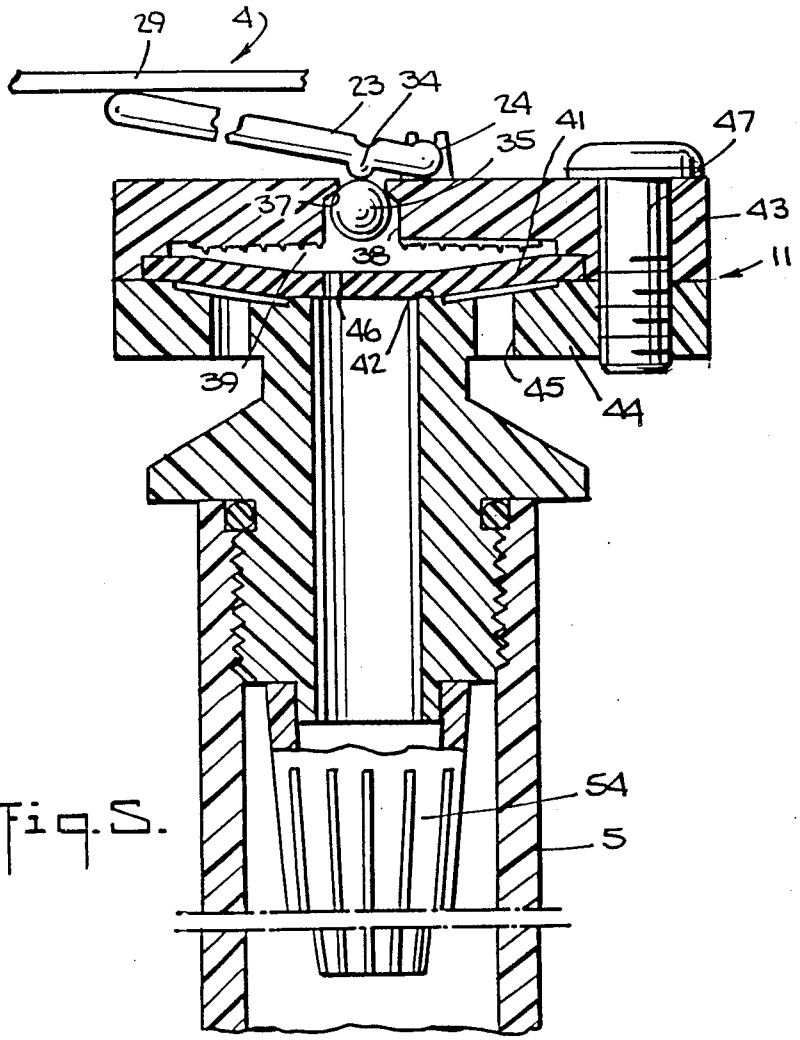
FIGS. 4 and 5 are enlarged detailed cross sectional views of the two stage inlet valve in opened and closed positions respectively.
Figure 4:
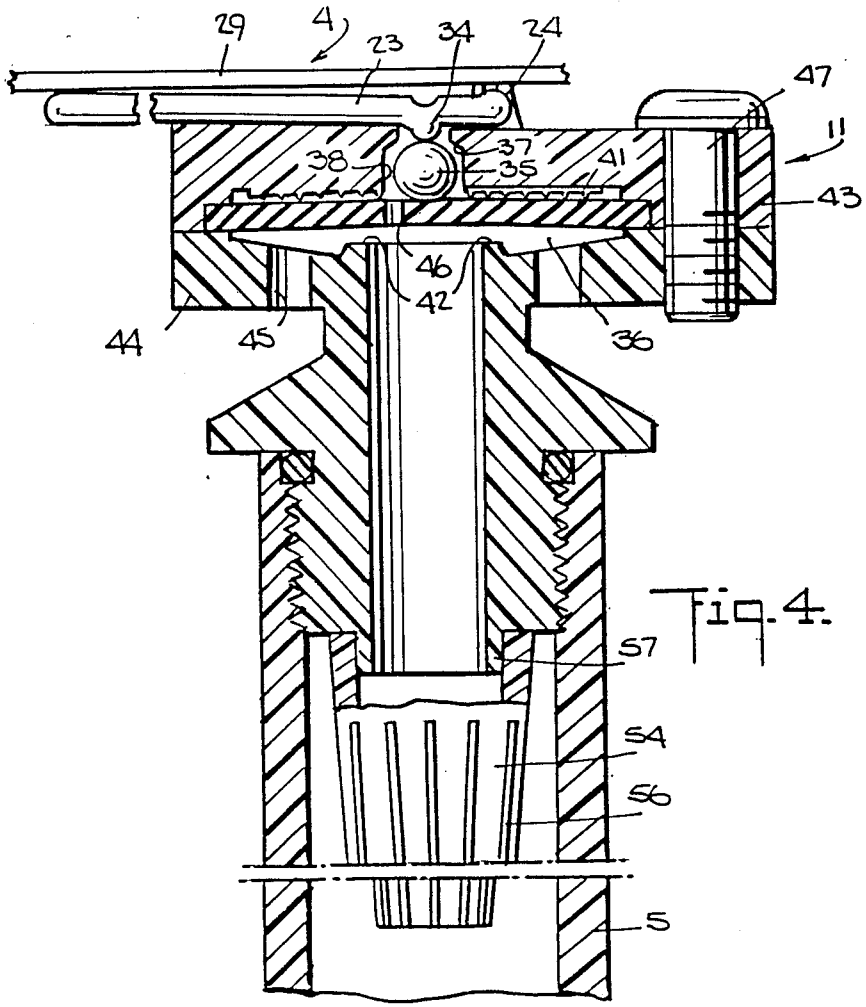

The inlet valve 11 is tightly fastened to the top of the inlet fitting 5 by a suitable threaded or welded connection at 22. A valve operating lever 23 is pivotally mounted at 24 (FIG. 4) on the valve 11 for control by the float 4. The float 4 includes a cylindrical inner sleeve 25 which slidably mounts it on the inlet fitting 5 for movement by the tank water between a raised or valve closed position, as illustrated in FIGS. 3 and 5, and a lowered or valve open position as illustrated in FIGS. 2 and 4.

The float 4 has a cylindrical outer shell 26 connected by an airtight flange 27 to the inner sleeve 25 which combine to form an air chamber beneath a central ballast chamber 28. Trapped air in this open bottomed chamber causes the float 4 to rise to its valve shut-off position as water 32 rises in the flush tank 1. The weight of water in the ballast chamber 28 controls the floating level of the float 4 to provide the valve shut-off at a desired level of tank water in a manner to be described below. A float cover 29 is attached to the float outer sleeve 26 by a suitable coupling such as a bead 30 which engages a flange 31 on the float 4.

The under surface of the float cover 29 provides a camming surface for engaging the above referred to valve operating lever 23. Water flowing from the valve 11 when it is opened accumulates in the chamber 28 and 40 and passes through the openings 40' around the float cover 29 as well as downwardly between the inner float sleeve 25 and the inlet fitting 5.

The operation of the inlet valve 11 will now be described with particular reference to detailed FIGS. 4 and 5. FIG. 5 illustrates the inlet valve 11 in its closed position corresponding to the filled tank situation as also illustrated in FIGS. 1 and 3. The float 4 has been raised by the water 32 in the tank 1 causing the interrelated inlet valve 11 to close.

The cover 29 of the float is illustrated in its floating or raised position spaced upwardly from the top of the inlet valve 11 (FIG. 5) with the valve operating lever 23 also in its raised or valve closed position. The lever 23 swings freely on the pivot 24 as, in its preferred form, it includes a counterbalancing portion 33 (FIG. 2) opposite to the float engaging portion. When the float top 29 has been lifted by the tank water 32, its downward force is removed from the lever 23 and the lever 23 tends to swing its ball engaging projection 34 upwardly by the action of the counterbalancing portion 33. This permits the valve ball 35 to be forced upwardly within the inlet valve cavity 36 against its seal 37 in outlet 38, as illustrated in FIGS. 3 and 5. The pressure of the inlet water passing through an aperture 46 in a flexible valve diaphragm 41 tends to move and to hold the ball 35 in this raised and shut position. Water in the cavity 39 above the diaphragm 41 is trapped causing its pressure to increase to the inlet pressure and the diaphragm 41 to flex downwardly against the lower sealing surface 42 of the inlet valve cavity 36. The flexible diaphragm 41 is gripped between the upper valve body portion 43 and the lower valve body portion 44 which are connected by the screw 47.

When the diaphragm 41 is in its downward or shut-off position, it seats against the lower sealing surface 42 closing off the several valve outlet ports 45 provided in the lower valve body portion 44.

The float 4 characteristics are set in combination with those of the inlet valve 11 operating lever 23 to permit the ball 35 to seat and seal the cavity 36 at a desired tank water level.

FIGS. 2 and 4 illustrate the inlet valve 11 in its open or tank filling position. The valve 11 is opened to the position illustrated in FIGS. 2 and 4 by the downward force of the float 4 on the operating lever 23 during a flushing operation. The lowering of the water 32 in the flush tank 1, after the flush valve 8 is opened, causes the float 4 and its top 29 to drop downwardly to the top of inlet valve 11 in the position illustrated in FIGS. 2 and 4 causing a corresponding downward movement of the projection 34 on the inlet valve operating lever 23. The projection 34 pushes the ball 35 downwardly and clear of the seat 37. Water in the valve cavity 36 above the diaphragm 41 now flows upwardly through the outlet 38 releasing the downward fluid pressure on the diaphragm 41 and exposing the lower surface of the diaphragm 41 to the pressure of the incoming water. The water pressure in the inlet fitting 5 holds the diaphragm 41 in its raised position with its diaphragm aperture 46 being closed by contact with the lower surface of ball 35. The principal water flow through the inlet fitting 5 passes outwardly through the several valve outlet ports 45 and thence through the float 4 into the tank 1.

A preferred embodiment has a hollow unitary molded filter 54 with elongated openings 56. Filter 54 snaps over a flange 57 on the valve 11.

The inlet valve 11 remains in its open position (FIGS. 2 and 4) until the float 4 is again raised by the filling of the tank 1 tot he level where the ball 35 is again forced upwardly against its seat 37.

THE FLUSHING VALVE

The operation of the tank flushing valve 8 and its cooperation with the above described inlet valve 11 and float 4 action will not be described.

FIG. 1 illustrates the tank 1 in its filled preflush or steady state condition ready for a flushing cycle. The float 4 is raised by the tank water level with its top 29 spaced upwardly from the inle valve 11 causing the ball 35 to be in its shut-off position as shown in FIGS. 3 and 5.

The flushing valve 8 (FIGS. 6 thru 8) comprises the vertically oriented hollow tube 14 which has its upper end connected at 9 to the flushing lever 7. The tank flushing handle 6 is pivotally mounted on the tank 1 wall so that clockwise rotation (FIG. 1) of the handle 6 lifts the lever 7 and its interconnected flush valve tube 14. A resilient conical gasket 12 is mounted on the lower end of the tube 14 for engagement with the generally cylindrical plastic valve seat 47 (FIG. 6) in the tank outlet 10. The valve seat 47 is held in position by a nut 48. The lower end of the valve tube 14 is centered in the valve seat 47 by spaced splines 51 positioned at the top of the valve seat.

A float 49, adjustably positioned on a threaded portion 52 of the flushing valve tube 14, controls the termination of the tank 1 draining operation. Once the gasket 12 on the flush valve tube 14 has been lifted clear of the tank outlet 10, the removal of the unbalanced water pressure on the valve gasket 12 permits the entire flush valve 8 to float in the tank water as the water drains through the outlet 10. This floating action holds the gasket 12 above the outlet 10 until the level of the tank water drops to the point when the gasket 12 again reseals the tank outlet 10 at valve seat 47 and which is determined by the position of the float 49 on the tube 14 threads 52.

This occurs while water is flowing into the tank 1 through the opened inlet valve 11. The water now rises in the tank 1 as the water pressure holds the gasket 12 closed and the tube 14 down due to the large area of the gasket 12 exposed to the water pressure within the tank 1. The water 32 continues to rise in the tank 1 until it moves the float 4 to its valve closing position already described and as illustrated in FIG. 3 and 5.

The amount of water employed in the flush is controlled by adjusting the position of the float 49 on the threaded adjustment portion 52 of the flush valve tube 14. For a large volume of flush water, the float 49 is positioned close to the flush valve. Should a lesser amount of water be desired for the flushing operation, the float 49 may be turned upwardly on the threaded portion 52 to a higer position. In the higher position, the float 49 causes an earlier closing of the flush valve 8 leaving a larger amount of water within the tank and thus a smaller flushing water flow.

The flushing valve 8 provides for a bowl filling action in the following manner. The inlet assembly 3 is arranged so that its float 4 shuts off the water flow into the tank 1 when the water rises to a level near the top of the over-flow tube 4.

At this level the inlet valve 11 closes. A bowl filling siphon 67 is mounted on the tube 14 a short distance down from the top of the tube 14. Water now drains from the tank 1 through the siphon 67 into the bowl until the tank water level falls low enough to interrupt the siphon flow.

The siphon 67, as illustrated in FIG. 6, comprises a generally "U-shaped" hollow tube which communicates with the interior of the overflow tube 14. The siphon 67 is pivotally mounted at 68 on pin 69 on the tube 14 so that it may be adjusted from the position of FIG. 6 to the position illustrated in FIG. 8 or any position in between. In the position of FIG. 6, the siphon has been swung to the maximum bowl fill position. This occurs because the rising water in the tank initiates the siphon flow when it reaches the top of the siphon at line A and the siphon thereafter flows until the water drops to the level of the outer end of the siphon, i.e. to the level of line B. When the siphon has been turned to the position illustrated in FIG. 8, it provides for a minimum bowl fill because the siphon is initiated when the water reaches the level of line C and operates only until the water drops again to the outer end of the siphon at the level of line D causing a minimum water flow to the bowl. During this time, the inlet valve 11 remains closed because there is a simultaneous drainage of the float 4 as the water within the float 4 falls to the top of the inner sleeve 25. This water drainage from within the float 4 causes the front 4 to rise so that its cover 29 remains above the inlet valve 11 which remains in its closed position.

Figure 9:
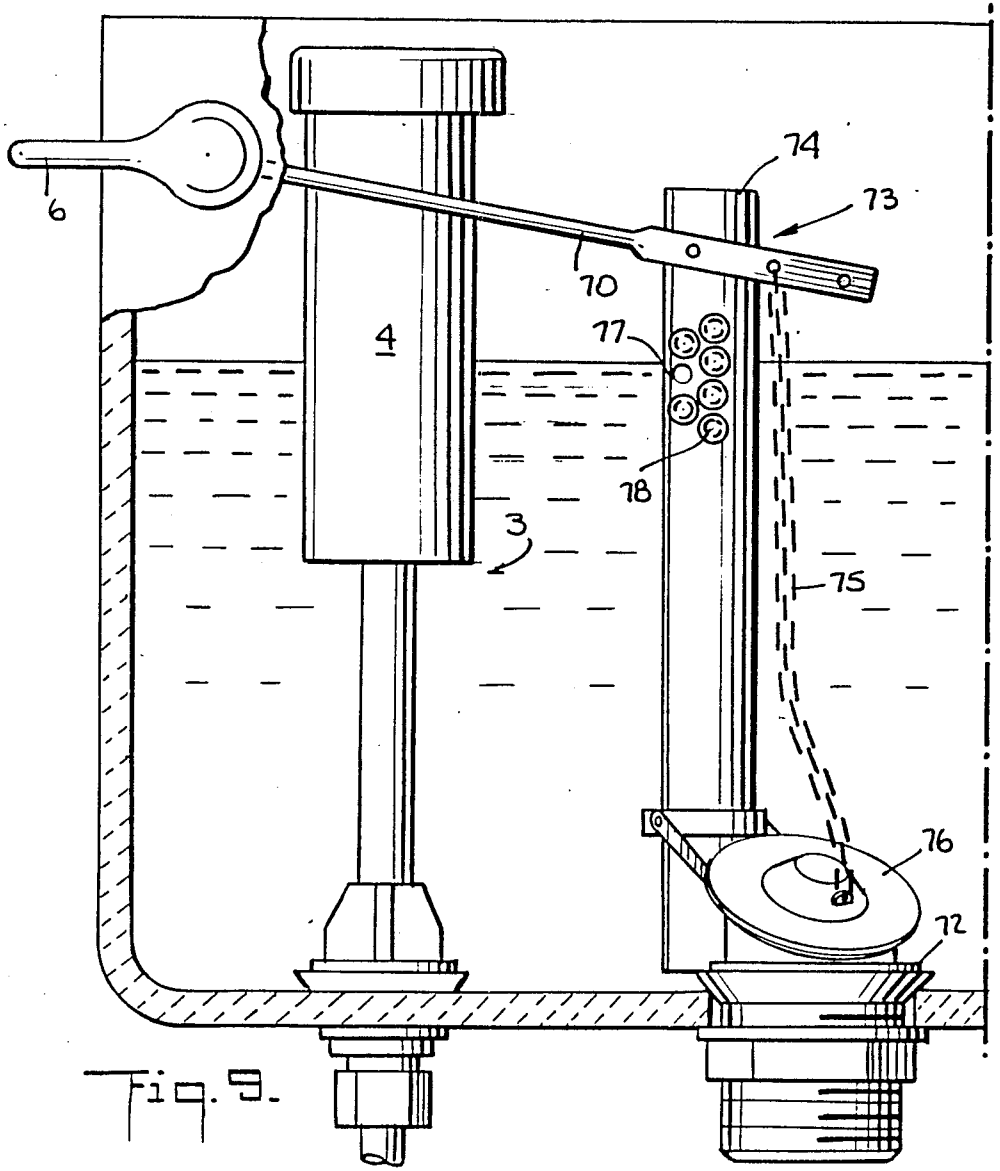
FIG. 9 is a sectional view of a toilet tank illustrating another embodiment of the flush valve of the present invention in its reclosed position.

FIG. 9 illustrates another embodiment in which the flusing mechanism 73 for the tank 71 has a floating flapper valve 76 pivotally attached to a fixedly mounted hollow bowl leveling tube 74 whose lower end communicates with a toilet bowl. Flapper valve 76 is opened by the handle 6 and lever 70 through an interconnecting chain 75 and closes when the level of tank water permits the floating valve 76 to reseal.

A bowl leveling action similar to that already described is provided by a series of spaced drain holes 77 in the tube 74. FIG. 9 shows a variation of the control of water through tube 74 to the toilet bowl for refill after the ballcock 4 shuts off. A series of holes 77 is located in the tube 74 with appropriate plugs 78 for the hole locations not used. It enables the correct amount of water to enter the toilet bowl after the inlet valve is closed by selecting a hole 77 at the desired level. This embodiment employs an inlet assembly 3 as described above for controlling the tank filling action and the holes may be used in place of the siphon 67 on the tube 14.

Figure 10:
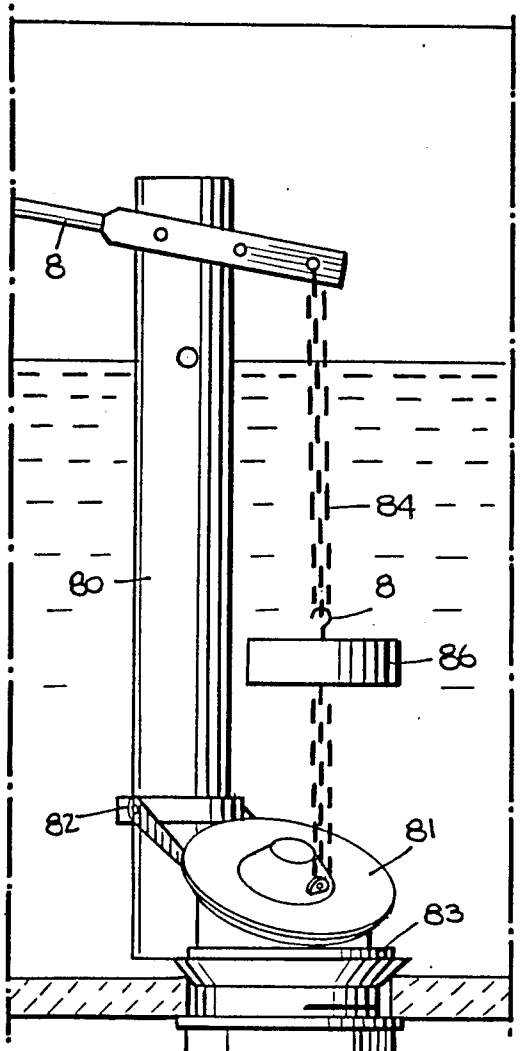
FIG. 10 is a still further embodiment of a flush valve.

FIG. 10 illustrates a still further embodiment of a tank flushing mechanism. It may be used with any inlet valve including the above described inlet assembly. The valve includes a bowl filling tube 80 similar to tube 74 already described and it may include a tank leveling means such as hole 88 or adjustable means such as the siphon 76 or the hole 77 array of FIG. 9. A flapper 81 is pivotally mounted at 82 for closing the tank outlet 83. This flapper 81 is non-floating and normally seals the tank outlet 83 under the force of its own weight and the weight of the tank water after it closes after tank drain down. The flap 81 is opened for the flushing operation by means of a chain 84 or other member coupling the flapper 81 to the flush lever 85. When the flapper 81 is raised by the lever 85, it remains open due to the upward pull of a float 86 adjustably positioned on the chain 84. The float 86 holds the flapper 81 open until the water level in the tank lowers the float 86 and the connected flapper 81 to reseal the outlet 83. The float 86 position is adjustably chosen using connector 87 to attach the float 86 to the chain 84 at a level determined by the volume of flushing water desired.

It will be seen that a simplified and reliable flushing means has been provided for a toilet tank. The means includes a minimum number of parts with most of the principal parts being adapted for being formed from molded plastic. A positively acting and adjustable flushing means as well as an adjustable bowl leveling siphon is provided which is durable and efficient and which may be manufactured at a relative low cost. The improved system, with a minimum number of working parts in an improved two stage inlet valve also provides a flushing system which is relatively maintenance free and which has a long working life.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

I claim:

1. In combination with a tank filling inlet valve, an improved flushing valve for sealing a flush tank outlet to a bowl comprising the combination of:

a stationary hollow tube;

means for mounting said hollow tube in a generally vertical position in said tank at a tank outlet;

aperture means on said hollow tube for admitting liquid to said hollow tube from said tank for bowl leveling, a movably mounted flapper valve spaced from said hollow tube for sealing a tank outlet, a member attached to a handle for lifting said flappe valve from a tank outlet, float means adjustably positioned on said member, said aperture means comprising a plurality of hole sites at this level with plug means in all except a preselected one whereby liquid is admitted in only said one preselected hole site.

* * * * *